US005096872A

United States Patent [19]

Tsuchida et al.

[11] Patent Number: 5,096,872

[45] Date of Patent: Mar. 17, 1992

[54] RECORDING MATERIAL

[75] Inventors: Tetsuo Tsuchida, Takarazuka; Fumio Seyama, Osaka; Tatsuya Meguro, Nishinomiya; Mitsuru Kondo, Hyogo, all of Japan

[73] Assignee: Kanzaki Paper Manufacturing Co., Ltd., Tokyo, Japan

[21] Appl. No.: 602,590

[22] Filed: Oct. 24, 1990

[30] Foreign Application Priority Data

Oct. 25, 1989 [JP] Japan ..... 1-279299

[51] Int. Cl.[5] ..... B41M 5/155; B41M 5/30; B41M 5/32

[52] U.S. Cl. ..... 503/210; 427/150; 503/211; 503/212; 503/216; 503/225

[58] Field of Search ..... 427/150–152; 503/210–212, 216, 217, 225

[56] References Cited

U.S. PATENT DOCUMENTS

| | | | |
|---|---|---|---|
| 3,864,146 | 2/1975 | Oda et al. | 117/36.8 |
| 3,924,027 | 12/1975 | Saito et al. | 427/147 |
| 4,236,732 | 12/1980 | Murakami et al. | 282/27.5 |
| 4,771,034 | 9/1988 | Ikeda et al. | 503/212 |
| 4,839,332 | 6/1989 | Ikeda et al. | 503/212 |
| 4,918,047 | 4/1990 | Ikeda et al. | 503/216 |
| 4,920,091 | 4/1990 | Iwakura et al. | 503/211 |

FOREIGN PATENT DOCUMENTS

| | | |
|---|---|---|
| 181283 | 5/1986 | European Pat. Off. . |
| 253666 | 1/1988 | European Pat. Off. . |
| 264051 | 4/1988 | European Pat. Off. . |

OTHER PUBLICATIONS

Japanese Patent Abstract, vol. 9, No. 223 (M–411) [1946] Sep. 10, 1985.

*Primary Examiner*—Bruce H. Hess

*Attorney, Agent, or Firm*—Armstrong, Nikaido, Marmelstein, Kubovcik & Murray

[57] ABSTRACT

The present invention provides a recording material utilizing the color forming reaction between a colorless or light-colored basic dye and a color acceptor reactive with the dye to form a color and forming on the same or different substrate layer or layers containing the basic dye and the color acceptor conjointly or separately, the recording material being characterized in that the color acceptor is at least one of salicylic acid derivatives represented by the following formula [I] or polyvalent metal salts thereof

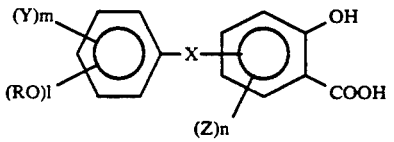

[I]

wherein X is straight-chain or branched-chain $C_{1\sim12}$ alkylene or $C_{5\sim12}$ cycloalkylene, R is $C_{1\sim20}$ alkyl having or not having a substituent or $C_{2\sim20}$ alkenyl having or not having a substituent, Y is $C_{1\sim6}$ alkyl, $C_{2\sim6}$ alkenyl, $C_{7\sim10}$ aralkyl or halogen atom, Z is $C_{1\sim6}$ alkyl, $C_{2\sim6}$ alkenyl, $C_{7\sim10}$ aralkyl, $C_{1\sim6}$ alkoxyl, cyclohexyl, phenyl, phenoxy or halogen atom, l is an integer of 1 to 3, m is zero or an integer of 1 to 4, n is zero or an integer of 1 to 3.

14 Claims, No Drawings

RECORDING MATERIAL

The present invention relates to recording materials, and more particularly to recording materials which are excellent in color forming ability, preservability of the material as prepared and preservability of the images recorded thereon.

Recording materials are known which utilize the color forming reaction between a colorless or light-colored basic dye and an organic or inorganic color acceptor. Such materials include pressure sensitive recording materials, heat sensitive recording materials and electrothermal recording materials as typical examples and further include various other materials.

The properties required of these recording materials are whiteness of the recording material per se, sufficient recording density and sensitivity, excellent preservability of recorded images and whiteness retainability in non-recorded portion in external environments involving temperature, humidity, chemicals or the like, etc., whereas materials fulfilling these requirements completely are still unavailable at present.

Heat sensitive recording materials which are relatively inexpensive and are, for example, used in various fields and in diversified forms with remarkable progress in heat sensitive recording systems in recent years. While they are useful as recording media for heat sensitive facsimile systems and heat sensitive printers, they are in rapidly growing uses for novel applications, for example, as POS (Point of Sales) labels.

However, heat sensitive recording materials generally have the drawback of becoming fogged up when affected by solvents or the like, or permitting the recorded images to undergo discoloration or fading. Especially, images recorded on the material markedly fade when brought into contact with plastics films, or the material is very susceptible to fogging when stored in contact with diazo copy paper, especially such paper bearing fresh copy images. It is therefore strongly desired to remedy these drawbacks or defects.

In view of the present situation described above, we have conducted extensive research on color acceptors in order to overcome the foregoing defects of the recording materials which utilize the color forming reaction between basic dyes and color acceptors.

An object of the present invention is to provide a recording material which is outstanding not only in color forming ability and preservability as prepared but also in the preservability of recorded images.

The above and other objects of the invention will become apparent from the following description.

The present invention provides a recording material utilizing the color forming reaction between a colorless or light-colored basic dye and a color acceptor reactive with the dye to form a color and forming on the same or different substrate a layer or layers containing the basic dye and the color acceptor conjointly or separately, the recording material being characterized in that the color acceptor is at least one of salicylic acid derivatives represented by the following formula [I] or polyvalent metal salts thereof

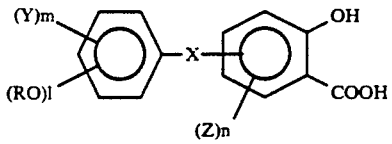

[I]

wherein X is straight-chain or branched-chain $C_{1\sim12}$ alkylene or $C_{5\sim12}$ cycloalkylene, R is $C_{1\sim20}$ alkyl having or not having a substituent or $C_{2\sim20}$ alkenyl having or not having a substituent, Y is $C_{1\sim6}$ alkyl, $C_{2\sim6}$ alkenyl, $C_{7\sim10}$ aralkyl or halogen atom, Z is $C_{1\sim6}$ alkyl, $C_{2\sim6}$ alkenyl, $C_{7\sim10}$ aralkyl, $C_{1\sim6}$ alkoxyl, cyclohexyl, phenyl, phenoxy or halogen atom, l is an integer of 1 to 3, m is zero or an integer of 1 to 4, n is zero or an integer of 1 to 3.

In the salicylic acid derivative of the above formula [I], R represents $C_{1\sim20}$ alkyl having or not having a substituent or $C_{2\sim20}$ alkenyl having or not having a substituent. Examples of preferable substituents are halogen atom, $C_{1\sim20}$ alkoxyl, $C_{2\sim20}$ alkoxyalkoxyl, $C_{2\sim20}$ alkenyloxy, phenyl, naphthyl, phenoxy, $C_{7\sim20}$ phenoxyalkoxyl, $C_{8\sim20}$ phenoxyalkoxyalkoxyl, naphthyloxy, phenylthio and phenylsulfonyl groups. Aromatic ring included in the substituent may further have a substituent such as halogen atom, $C_{1\sim4}$ alkyl, $C_{1\sim4}$ alkoxyl, phenyl, phenoxy and $C_{2\sim5}$ alkoxycarbonyl groups.

Among the above salicylic acids, preferable are those which are 8 to 26 in total carbon number of R including an optionally bonded substituent, and more preferable are those in which R is represented by the formula [II] since they afford excellent properties,

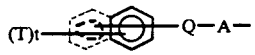

[II]

wherein T is halogen atom, $C_{1\sim4}$ alkyl or $C_{1\sim4}$ alkoxyl, Q is —O— bond or —$SO_2$— bond, A is $C_{2\sim6}$ alkylene having or not having one or two ether bonds, t is zero or an integer of 1 to 5.

In the salicylic acid of the formula [I], X is straight-chain or branched-chain $C_{1\sim12}$ alkylene or $C_{5\sim12}$ cycloalkylene. Among the above, preferable are those in which X is straight-chain or branched-chain $C_{1\sim6}$ alkylene, and particularly preferable are those having X of isopropylidene group, in which starting materials are easily available.

Further, in the salicylic acid of the formula [I], Y is $C_{1\sim6}$ alkyl, $C_{2\sim6}$ alkenyl, $C_{7\sim10}$ aralkyl or halogen atom. Among the above, preferable are those in which Y is $C_{1\sim4}$ alkyl, chlorine atom or bromine atom.

In the salicylic acid of the formula [I], Z is $C_{1\sim6}$ alkyl, $C_{2\sim6}$ alkenyl, $C_{7\sim10}$ aralkyl, $C_{1\sim6}$ alkoxyl, cyclohexyl, phenyl, phenoxy or halogen atom. Among the above, preferable are those in which Z is $C_{1\sim4}$ alkyl, $C_{1\sim4}$ alkoxyl, chlorine atom or bromine atom.

In the salicylic acid of the formula [I], l is an integer of 1 to 3, m is zero or an integer of 1 to 4, n is zero or an integer of 1 to 3. Among the above, preferable are those in which l is 1, m and n are zero, because the derivative is easily prepared.

Polyvalent metals which forms a salt with the salicylic acid derivative of the above formula [I] are those having 2, 3 or 4 valency, preferably zinc, calcium, aluminum, magnesium, tin or iron, and most preferably zinc.

The salicylic acid derivative of the above formula [I] can be prepared by a known method, for example, by alkylating a corresponding salicylic acid derivative or by carboxylating a corresponding phenol derivative.

The recording material having incorporated herein the salicylic acid derivative or polyvalent metal salt thereof according to the invention is satisfactory in color density and forms color images which are highly stable and undergo little or no discoloration or fading even when exposed to sunlight for a prolonged period of time or when preserved at high temperatures or high humidities. The material is therefore very advantageous from the viewpoint of long-term preservation of records. The present material is especially usable as a heat sensitive recording material without permitting the blank portion to develop a color due to contact with solvents or the like and without permitting the recorded images to discolor or fade in the presence of oils or fats, chemicals or the like. Thus, the specified compound used exhibits excellent characteristics as a color acceptor.

The followings are examples of the salicylic acid derivatives of the formula [I].

5-(p-methoxycumyl)salicylic acid, 3-(p-methoxycumyl)salicylic acid, 5-(o-methoxycumyl)salicylic acid, 5-(m-methoxycumyl)salicylic acid, 4-(p-methoxycumyl)salicylic acid, 5-(p-ethoxycumyl)salicylic acid, 5-(p-isopropoxycumyl)salicylic acid, 3-(p-isopropoxycumyl)salicylic acid, 5-(p-tert-butoxycumyl)salicylic acid, 5-(p-n-hexyloxycumyl)salicylic acid, 5-(p-n-dodecyloxycumyl)salicylic acid, 5-(p-n-octadecyloxycumyl)salicylic acid, 3-(p-n-octadecyloxycumyl)salicylic acid, 5-(p-vinyloxycumyl)salicylic acid, 5-(p-allyloxycumyl)salicylic acid, 5-(p-methoxymethoxycumyl)salicylic acid, 5-[p-(2-methoxyethoxy)cumyl]salicylic acid, 5-[p-(2-ethoxyethoxy)cumyl]salicylic acid, 5-[p-(2-dodecyloxyethoxy)cumyl]salicylic acid, 5-[p-(2-benzyloxyethoxy)cumyl]salicylic acid, 3-[p-(2-benzyloxyethoxy)cumyl]salicylic acid, 4-[p-(2-benzyloxyethoxy)cumyl]salicylic acid, 5-[p-(2-p-methoxybenzylethoxy)cumyl]salicylic acid, 5-[p-(2-vinyloxyethoxy)cumyl]salicylic acid, 5-[p-(3,5-dioxa-heptyloxy)cumyl]salicylic acid, 5-(p-cinnamyloxycumyl)salicylic acid, 5-[p-(2-phenoxyethoxy)cumyl]salicylic acid, 5-[o-(2-phenoxyethoxy)cumyl]salicylic acid, 5-[m-(2-phenoxyethoxy)cumyl]salicylic acid, 3-[p-(2-phenoxyethoxy)cumyl]salicylic acid, 4-[p-(2-phenoxyethoxy)cumyl]salicylic acid, 5-[p-(3-phenoxypropoxy)cumyl]salicylic acid, 3-[p-(3-phenoxypropoxy)cumyl]salicylic acid, 5-[p-(4-phenoxybutoxy)cumyl]salicylic acid, 4-[p-(4-phenoxybutoxy)cumyl]salicylic acid, 5-[p-(5-phenoxy-3-oxa-pentyloxy)cumyl]salicylic acid, 5-[p-(9-phenoxy-3,6-dioxa-undecyloxy)cumyl]salicylic acid, 5-[p-(7-phenoxy-3,5-dioxa-heptyloxy)cumyl]salicylic acid, 5-[p-(2-p-methoxyphenoxyethoxy)cumyl]salicylic acid, 3-[p-(2-p-methoxyphenoxyethoxy)cumyl]salicylic acid, 4-[p-(2-p-methoxyphenoxyethoxy)cumyl]salicylic acid, 5-[o-(2-p-methoxyphenoxyethoxy)cumyl]salicylic acid, 5-[p-(2-p-ethoxyphenoxyethoxy)cumyl]salicylic acid, 5-[p-(2-p-isopropoxyphenoxyethoxy)cumyl]salicylic acid, 5-[p-(2-p-tert-butoxyphenoxyethoxy)cumyl]salicylic acid, 5-{p-[2-p-(2-methoxyethoxy)phenoxyethoxy]cumyl}salicylic acid, 5-[p-(3-p-methoxyphenoxypropoxy)cumyl]salicylic acid, 5-[p-(4-p-methoxyphenoxybutoxy)cumyl]salicylic acid, 5-[p-(5-p-methoxyphenoxy-3-oxa-pentyloxy)cumyl]salicylic acid, 5-[p-(2-p-tolyloxyethoxy)cumyl]salicylic acid, 3-[p-(2-p-ethylphenoxyethoxy)cumyl]salicylic acid, 4-[p-(2-p-chlorophenoxyethoxy)cumyl]salicylic acid, 5-[p-(2-p-bromophenoxyethoxy)cumyl]salicylic acid, 5-[p-(3-p-tolyloxypropoxy)cumyl]salicylic acid, 5-[p-(4-p-chlorophenoxybutoxy)cumyl]salicylic acid, 5-(p-benzyloxycumyl)salicylic acid, 5-(p-phenethyloxycumyl)salicylic acid, 5-[p-(2-β-naphthyloxyethoxy)cumyl]salicylic acid, 5-[p-(2-α-naphthyloxyethoxy)cumyl]salicylic acid, 5-[p-(3-p-tolylsulfonylpropoxy)cumyl]salicylic acid, 5-[p-(4-p-tolylsulfonylbutoxy)cumyl]salicylic acid, 5-[p-(3-phenylsulfonylpropoxy)cumyl]salicylic acid, 5-[p-(6-phenylsulfonylhexyloxy)cumyl]salicylic acid, 5-[p-(3-p-methoxyphenylsulfonylpropoxy)cumyl]salicylic acid, 5-[p-(4-p-methoxyphenylsulfonylbutoxy)cumyl]salicylic acid, 5-[p-(4-phenylsulfonylbutoxy)cumyl]salicylic acid, 5-[p-(6-p-chlorophenylsulfonylhexyloxy)cumyl]salicylic acid, 5-[p-(2-phenylthioethoxy)cumyl]salicylic acid, 5-[p-(4-phenylthiobutoxy)cumyl]salicylic acid, 5-[p-(3-p-chlorophenylthiopropoxy)cumyl]salicylic acid, 5-[p-(6-p-chlorophenylthiohexyloxy)cumyl]salicylic acid, 5-[p-(2-phenoxyethoxy)benzyl]salicylic acid, 3-[p-(2-phenoxyethoxy)benzyl]salicylic acid, 5-[p-(2-phenoxyethoxy)phenethyl]salicylic acid, 5-[3-(p-2-phenoxyethoxyphenyl)propyl]salicylic acid, 3-[4-(p-2-phenoxyethoxyphenyl)butyl]salicylic acid, 5-[6-(p-2-phenoxyethoxyphenyl)hexyl]salicylic acid, 5-[8-(p-2-phenoxyethoxyphenyl)octyl]salicylic acid, 5-[12-(p-2-phenoxyethoxyphenyl)dodecyl]salicylic acid, 5-[α-methyl-p-(2-phenoxyethoxy)benzyl]salicylic acid, 5-[α-methyl-α-ethyl-p-(2-phenoxyethoxy)benzyl]salicylic acid, 5-[α-methyl-α-isopropyl-p-(2-phenoxyethoxy)benzyl]salicylic acid, 3-[α-methyl-α-isopropyl-p-(2-phenoxyethoxy)benzyl]salicylic acid, 5-[α-methyl-α-isobutyl-p-(2-phenoxyethoxy)benzyl]salicylic acid, 5-[1-p-(2-phenoxyethoxy)phenylcyclohexyl]salicylic acid, 5-[1-p-(2-phenoxyethoxy)phenylcyclopentyl]salicylic acid, 5-[p-(2-p-methoxyphenoxyethoxy)benzyl]salicylic acid, 5-[p-(2-p-methoxyphenoxyethoxy)phenethyl]salicylic acid, 5-[α-methyl-p-(2-p-methoxyphenoxyethoxy)benzyl]salicylic acid, 5-[α-methyl-α-ethyl-p-(2-p-methoxyphenoxyethoxy)benzyl]salicylic acid, 5-[α-methyl-α-isopropyl-p-(2-p-methoxyphenoxyethoxy)benzyl]salicylic acid, 5-[α-methyl-α-isobutyl-p-(2-p-methoxyphenoxyethoxy)benzyl]salicylic acid, 5-[p-(3-p-methoxyphenylsulfonylpropoxy)benzyl]salicylic acid, 5-[p-(3-phenylsulfonylpropoxy)phenethyl]salicylic acid, 5-[α-methyl-p-(3-p-tolylsulfonylpropoxy)benzyl]salicylic acid, 5-[α-methyl-α-ethyl-p-(3-p-chlorophenylsulfonylpropoxy)benzyl]salicylic acid, 5-[α-methyl-α-isopropyl-p-(3-p-tolylsulfonylpropoxy)benzyl]salicylic acid, 5-(p-n-dodecyloxybenzyl)salicylic acid, 3-(p-n-octadecyloxybenzyl)salicylic acid, 5-(p-n-octadecyloxyphenethyl)salicylic acid, 5-(α-methyl-p-n-octadecyloxybenzyl)salicylic acid, 5-(α-methyl-α-isopropyl-p-n-dodecyloxybenzyl)salicylic acid, 5-(α-methyl-α-isobutyl-p-isopropoxybenzyl)salicylic acid, 5-(1-p-methoxyphenylcyclohexyl)salicylic acid, 5-[p-(3-p-tolylsulfonylpropoxy)benzyl]salicylic acid, 5-[α-methyl-α-isopropyl-p-(3-p-tolylsulfonylpropoxy)benzyl]salicylic acid, 5-[m-methyl-p-(2-phenoxyethoxy)cumyl]salicylic acid, 5-[m-ethyl-p-(2-phenoxyethoxy)cumyl]salicylic acid, 5-[m-tert-butyl-p-(2-phenoxyethoxy)cumyl]salicylic acid, 5-[m-vinyl-p-(2-phenoxyethoxy)cumyl]salicylic acid, 5-[m-allyl-p-(2-phenoxyethoxy)cumyl]salicylic acid, 5-[m-benzyl-p-(2-phenoxyethoxy)cumyl]salicylic acid, 5-[m-chloro-p-(2-phenoxyethoxy)cumyl]salicylic acid, 5-[m,m'-dimethyl-p-(2-phenoxyethoxy)cumyl]salicylic acid, 5-[m,m'-dichloro-p-(2-phenoxyethoxy)cumyl]salicylic acid, 5-[m-methyl-o-(2-phenoxyethoxy)cumyl]-salicylic acid, 5-[m-tert-butyl-o-(2-phenoxyethoxy)-cumyl]salicylic acid, 5-(m-methyl-p-methoxycumyl)-salicylic acid, 5-(m-methyl-o-isopropoxycumyl)salicylic acid, 5-(2,4-diisopropoxycumyl)salicylic acid, 5-(2,4,6-triisopropoxycumyl)salicylic acid, 5-[o-methoxy-p-(2-phenoxyethoxy)cumyl]salicylic acid, 3-methyl-5-[p-(2-phenoxyethoxy)cumyl]salicylic acid, 3-cyclohexyl-5-[p-(2-phenoxyethoxy)cumyl]salicylic acid, 3-allyl-5-[p-(2-phenoxyethoxy)cumyl]salicylic acid, 3-α,α-dimethylbenzyl-5-[p-(2-phenoxyethoxy)cumyl]salicylic acid, 3-phenyl-5-[p-(2-phenoxyethoxy)cumyl]salicylic acid, 3-chloro-5-[p-(2-phenoxyethoxy)cumyl]salicylic acid, 3-bromo-5-[p-(2-phenoxyethoxy)cumyl]salicylic acid, 3-methoxy-5-[p-(2-phenoxyethoxy)cumyl]salicylic acid, 5-methyl-3-[p-(2-phenoxyethoxy)cumyl]salicylic acid, 5-α-methylbenzyl-3-[p-(2-phenoxyethoxy)cumyl]salicylic acid, 3-methyl-5-(p-methoxycumyl)salicylic acid, 3,6-dimethyl-5-(p-methoxycumyl)salicylic acid, 3-chloro-5-(p-n-octadecyloxycumyl)salicylic acid, 3-methoxy-5-(p-n-dodecyloxycumyl)salicylic acid and 5-methyl-3-(p-isopropoxycumyl)salicylic acid.

The above salicylic acid derivatives and/or polyvalent metal salts thereof are used, as required, in a mixture of at least two of them.

The amount of the salicylic acid derivative and/or polyvalent metal salt thereof is not particularly limited but is usually 50 to 500 parts by weight, preferably 100 to 500 parts by weight per 100 parts by weight of the basic dye.

In the present invention, although the recording material which is excellent in color forming ability, preservability of the material as prepared and preservability of the recorded images can be obtained by use of, as a color acceptor, the salicylic acid derivative of the formula [I] and/or polyvalent metal salt thereof, the above properties can be further enhanced by cojoint use of a metal compound.

Examples of these metal compounds are oxide, hydroxide, sulfide, halide, carbonate, phosphate, silicate, sulfate, nitrate, aluminate, aluminosilicate or halogen complex salt of a metal having 2, 3 or 4 valency such as zinc, magnesium, barium, calcium, aluminum, tin, titanium, nickel, cobalt, manganese or iron. Among these, particularly preferable is a zinc compound.

Examples of the metal compounds are zinc oxide, zinc hydroxide, zinc aluminate, zinc sulfide, zinc carbonate, zinc phosphate, zinc silicate, aluminum oxide, magnesium oxide, titanium oxide, aluminum hydroxide, aluminum silicate, aluminum aluminosilicate, aluminum phosphate, magnesium aluminate, magnesium hydroxide, magnesium carbonate and magnesium phosphate. These metal compounds can be used, as required, in a mixture of at least two of them.

The amount of the metal compound is not necessarily limited and is usually 1 to 500 parts by weight, preferably 5 to 300 parts by weight per 100 parts by weight of the salicylic acid derivative of the formula [I] and/or polyvalent metal salt thereof.

In the present recording material, it is possible to use various known color acceptors in an amount which does not cause adverse effect. The followings are examples of the known color acceptors.

Inorganic color acceptors:

Acidic clay, activated clay, attapulgite, bentonite, colloidal silica, calcined kaolin and talc.

Organic color acceptors:

Aliphatic carboxylic acids, e.g., oxalic acid, maleic acid, tartaric acid, citric acid, succinic acid and stearic acid.

Aromatic carboxylic acids, e.g., benzoic acid, 4-tert-butylbenzoic acid, 4-chlorobenzoic acid, 4-nitrobenzoic acid, phthalic acid, gallic acid, salicylic acid, 3-isopropylsalicylic acid, 3-phenylsalicylic acid, 3-cyclohexylsalicylic acid, 3,5-di-tert-butylsalicylic acid, 3-methyl-5-benzylsalicylic acid, 3-phenyl-5-(α,α-dimethylbenzyl)salicylic acid, 3,5-di-(α-methylbenzyl)salicylic acid and 2-hydroxy-1-benzyl-3-naphthoic acid.

Phenolic compounds, e.g., 4,4'-isopropylidenediphenol (bisphenol A), 4,4'-isopropylidenebis(2-chlorophenol), 4,4'-isopropylidenebis(2,6-dichlorophenol), 4,4'-isopropylidenebis(2,6-dibromophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 2,2-bis(4-hydroxyphenyl)-4-methylpentane, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, methyl 4-hydroxybenzoate, benzyl 4-hydroxybenzoate, 2,2'-thiobis(4,6-dichlorophenol), 4-tert-octylcatechol, 2,2'-methylenebis(4-chlorophenol), 2,2'-methylenebis(4-methyl-6-tert-butylphenol), 2,2'-dihydroxybiphenyl, methyl bis(4-hydroxyphenyl)acetate, ethyl bis(4-hydroxyphenyl)acetate, butyl bis(4-hydroxyphenyl)acetate, benzyl bis(4-hydroxyphenyl)acetate, 2-phenoxyethyl bis(4-hydroxyphenyl)acetate, 2-(4-hydroxyphenylthio)ethyl (4-hydroxyphenylthio)acetate, 4,4'-(p-phenylenediisopropylidene)diphenol, 4,4'-(m-phenylenediisopropylidene)diphenol, 4-hydroxydiphenylsulfone, 4,4'-dihydroxydiphenylsulfone, 4-hydroxy-4'-methyldiphenylsulfone, 4-hydroxy-4'-isopropoxydiphenylsulfone, 4-hydroxy-3',4'-tetramethylenediphenylsulfone, 3,3'-diallyl-4,4'-dihydroxydiphenylsulfone, p-hydroxy-N-(2-phenoxyethyl)benzenesulfonamide, dimethyl 4-hydroxyphthalate, 1,5-bis(4-hydroxyphenylthio)-3-oxa-pentane, 1,7-bis(4-hydroxyphenylthio)-3,5-dioxa-heptane and 1,8-bis(4-hydroxyphenylthio)-3,6-dioxa-octane.

Phenolic resins, e.g., p-phenylphenol-formalin resin and p-butylphenol-acetylene resin.

Salt of the organic color acceptor with a polyvalent metal such as zinc, magnesium, aluminum, calcium, titanium, manganese, tin and nickel.

Metal complex, e.g., antipyrine complex with zinc thiocyanate.

Inorganic acids, e.g., hydrogen chloride, hydrogen bromide, hydrogen iodide, broric acid, silicic acid, phosphoric acid, sulfuric acid, nitric acid and perchloric acid.

Halides of aluminum, zinc, nickel, tin, titanium and boron.

Organic halogen compounds, e.g., carbon tetrabromide, α,α,α-tribromoacetophenone, hexachloroethane, iodoform, 2-tribromomethylpyridine and trichloromethylsulfonylbenzene.

o-Quinonediazide compounds.

Phenol esters of carboxylic acid or sulfonic acid which are subject to photo Fries rearrangement.

Diazo compounds, e.g., tetraphenylboron salt of 4-diazo-1-morpholino-2,5-dibutoxybenzene.

In the present recording material, various dyes are known as the colorless or light-colored basic dye which is used in combination with the above specific salicylic acid derivative or polyvalent matel salt thereof. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(4-dimethylaminophenyl)-3-(4-diethylamino-2-methylphenyl)-6-(dimethylamino)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucouramine, N-2,4,5-trichlorophenyl-leucoauramine, etc.

Divinylphthalide-based dyes, e.g., 3,3-bis[1,1-bis(4-pyrrolidinophenyl)ethylene-2-yl]-4,5,6,7-tetrabromophthalide, 3,3-bis[1-(4-methoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho(6'-methoxybenzo)spiropyran, 3-propyl-spiro-dibenzopyran, etc.

Lactam-based dyes, e.g., rhodamine-B-anilinolactam, rhodamine(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-diethylaminofluoran, 4-benzylamino-8-diethylaminobenzo[a]fluoran, 3-[4-(4-dimethylaminoanilino)anilino]-7-chloro-6-methylfluoran, 8-[4-(4-dimethylaminoanilino)anilino]-benzo[a]fluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-(N-ethyl-N-tetrahydrofurfurylamino)-6-methyl-7-phenylaminofluoran, 3-(N-methyl-N-n-propylamino)-6-methyl-7-phenylaminofluoran, 3-(N-ethyl-N-isobutylamino)-6-methyl-7-phenylaminofluoran, 3-(N-methyl-N-n-hexylamino)-6-methyl-7-phenylaminofluoran, 3-dipentylamino-6-methyl-7-phenylaminofluoran, 3-[N-(3-ethpoxypropyl)-N-methylamino]-6-methyl-7-phenylaminofluoran, 3-[N-ethyl-N-(3-ethoxypropyl)amino]-6-methyl-7-phenylaminofluoran, 3-diethylamino-7-[m-(trifluoromethyl)phenylamino]fluoran, 3-diethylamino-7-(o-fluorophenylamino)fluoran, 3-dibutylamino-7-(o-fluorophenylamino)fluoran, 3-diethylamino-b 6-chloro-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, etc.

Fluorene-based dyes, e.g., 3,6-bis(dimethylamino)-fluorene-9-spiro-3'-(6'-dimethylamino)phthalide, 3-diethylamino-6-(N-allyl-N-methylamino)fluorene-9-spiro-3'-(6'-dimethylamino)phthalide, 3,6-bis(dimethylamino)-spiro[fluorene-9,6'-6'H-chromeno(4,3-b)indole], 3,6-bis(dimethylamino)-3'-methyl-spiro[fluorene-9,6'-6'H-chromeno(4,3-b)indole], 3,6-bis(diethylamino)-3'-methyl-spiro[fluorene-9,6'-6'H-chromeno(4,3-b)indole], etc. These basic dyes are not limited to thereabove and can be used, as required, in a mixture of at least two of them.

In case of a heat sensitive recording material and the like, it is possible to use various heat-fusible substances as the record sensitivity improving agent to obtain high-speed recording amenability. Examples of heat-fusible substances are caproic acid amide, capric acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide, polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(4-methoxyphenoxy)-2-(2-methylphenoxy)ethane, terephthalic acid dibenzyl ester, dibenzyl oxalate, di(p-methylbenzyl)oxalate, benzyl p-benzyloxybenzoate, p-benzylbiphenyl, 1,5-bis(p-methoxyphenoxy)-3-oxa-pentane, 1,4-bis(2-vinyloxyethoxy)benzene, p-biphenyl p-tolyl ether and benzyl p-methylthiophenyl ether. The amount of the heat-fusible substance is not particularly limited and is usually 50 to 700 parts by weight, preferably 100 to 500 parts by weight per 100 parts by weight of the basic dye.

A detailed description will be given of typical recording materials which have incorporated therein salicylic acid derivatives of the formula [I] and/or polyvalent metal salts thereof, along with basic dyes such as those mentioned above.

Pressure sensitive recording materials are of various types as disclosed, for example, in U.S. Pat. Nos. 2,505,470, 2,505,471, 2,505,489, 2,548,366, 2,712,507, 2,730,456, 2,730,457, 3,418,250, 3,924,027, 4,010,038, etc. The present invention is applicable to such a wide variety of pressure sensitive recording materials.

Generally, color acceptor sheets (under sheets) are prepared by dispersing at least one of the salicylic acid derivatives or polyvalent metal salts thereof according to the invention in an binder, such as styrene-butadiene copolymer latex or polyvinyl alcohol, along with other color acceptors and pigments which are used as required to obtain a color acceptor coating composition, and applying the composition to a suitable substrate such as paper, plastics sheet or resin-coated paper.

On the other hand, basic dye sheets (upper sheets) for use in combination with such color acceptor sheets are prepared by dissolving a basic dye in a suitable solvent, dispersing the solution in a binder and applying the dispersion to a suitable substrate such as paper, plastics sheet or resin-coated paper. Examples of useful solvents are alkylated naphthalene, alkylated diphenyl, alkylated diphenylmethane, alkylated, terphenyl and like synthetic oils; cotton seed oil; castor oil and like vegetable oils; animal oils; mineral oils; and mixtures of such oils. Alternatively, the dispersion to be applied to the substrate is prepared by encapsulating the solution of basic dye by a coacervation process, interfacial polymerization process, in-situ polymerization process or other encapsulation process and dispersing the resulting microcapsules in a binder.

The pressure sensitive recording materials to be prepared according to the invention of course include middle sheets which are prepared by applying the color acceptor coating composition to one surface of a substrate and applying the dye dispersion or dye encapsulated dispersion to the other surface; self-contained type pressure sensitive recording sheets which are prepared by coating one surface of a substrate with a composition containing dye capsules and the color acceptor in mixture, or with the dye encapsulated dispersion and further with the color acceptor coating composition, so as to make the encapsulated dye and the color acceptor conjointly present on the same surface; and sheets of other types as already stated.

The amounts of basic dye and color acceptor to be used vary with the desired amount to be applied to the substrate, type of pressure sensitive recording material, encapsulating process, composition of the liquid to be applied inclusive of auxiliary agents, method of application and like conditions, so that the amounts are suitably determined in accordance with the conditions involved.

Heat sensitive recording materials are of various types as disclosed, for example, in JP-B-3680/1969, -27880/1969, -14039/1970, -43830/1973, -69/1974, -70/1974 and 20142/1977. The salicylic acid derivatives or polyvalent metal salts of the invention can be used for such a wide variety of heat sensitive recording materials.

Generally, heat sensitive recording materials are preparing according to the invention by dispersing particles of a basic dye and at least one of the salicylic acid derivatives of the invention or polyvalent metal salts thereof in a medium having a binder dissolved or dispersed therein, and applying the resulting dispersion to a suitable substrate such as paper, plastics film, synthetic paper, non-woven fabric sheet or molding. Although the proportions of basic dye and color acceptor to be used for the recording layer are not limited specifically, the color acceptor is used generally in an amount of 1 to 50 parts by weight, preferably about 1 to about 10 parts by weight, per part by weight of the dye.

To give improved color forming ability, deluster the surface of the recording layer and assure improved writability, inorganic pigments can be used generally in an amount of 0.1 to 10 parts by weight, preferably about 0.5 to about 3 parts by weight, per part by weight of the color acceptor. When required, it is further possible to conjointly use various auxiliary agents, such as dispersant, ultraviolet absorber, heat-fusible substance (record sensitivity enhancing agent), defoaming agent, fluorescent dye,coloring dye, etc.

As already described, the heat sensitive recording material of the invention is prepared generally by dispersing a finely divided basic dye and a finely divided color acceptor in a medium and coating a substrate with the dispersion, while separate dispersions of the basic dye and the color acceptor may be applied to the substrate in the form of a double coating. It is of course possible to prepare the material by impregnation or paper making process.

The method of preparing the coating composition or the method of application is not specifically limited. The dispersion or coating composition is applied generally in an amount of about 2 to about 12 g/m$^2$ by dry weight. Further it is possible to form an overcoat layer over the recording layer to protect this layer, or to provide a primary coating layer over the substrate. Thus, various techniques known in the art can be suitably resorted to.

Examples of suitable binders are starches, celluloses, proteins, gum arabic, polyvinyl alcohols, styrene-maleic anhydride copolymer salts, vinyl acetate-maleic anhydride copolymer salts, polyacrylates, styrene-butadiene copolymer emulsions, etc. The binder is added usually in an amount of 10 to 40% by weight, preferably 15 to 30% by weight based on the total solids of the coating composition.

Electrothermal recording materials are prepared, for example, by methods disclosed in JP-A-11344/1974 and -48930/1975. Such materials are produced generally by preparing a coating composition in the form of a dispersion of an electrically conductive substance, basic dye, color acceptor and binder, and applying the composition to a suitable substrate such as paper, or by coating the substrate with the electrically conductive substance to form a conductive layer, and further coating the layer with a coating composition in the form of a dispersion of dye, color acceptor and binder. In the case where neither of the dye and the color acceptor melt at preferred temperatures of 70° to 120° C., a suitable heat-fusible substance can be used in combination therewith to afford adjusted sensitivity to Joule heat.

Thus, the present recording metarial is excellent in color density, forms color images which undergo no discoloration without permitting the blank portion to develop a color even when preserved at high temperatures or high humidities or contacted with chemicals or the like. The material has therefore characteristics well-balanced in qualities.

The invention will be described below in more detail with reference to Examples by no means limited to, in which parts and percentages are all by weight, unless otherwise specified.

EXAMPLE 1

In 100 parts of isopropylnaphthalene was dissolved 6 parts of 3-(N-ethyl-N-isoamylamino)-6-methyl-7-phenylaminofluoran. The solution was added to 350 parts of warm (50° C.) water having dissolved therein 25 parts of pig skin gelatin of isoelectric point of 8 and 25 parts of gum arabic to obtain an emulsion. To the emulsion was added 1000 parts of warm water and the mixture was adjusted to pH 4 with the addition of acetic acid, then cooled to 10° C. Thereto was added 10 parts of 25% aqueous solution of glutaraldehyde to cure capsules. The capsule-containing composition was applied to one of the surfaces of a paper substrate weighing 45 g/m² in an amount of 5 g/m² by dry weight to prepare a basic dye sheet.

Separately, in 200 parts of water were dispersed 20 parts of zinc salt of 5-[p-(2-phenoxyethoxy)cumyl]salicylic acid, 80 parts of kaolin and 30 parts of styrene-butadiene copolymer emulsion (50% solid) to prepare a coating composition containing a color acceptor. The coating composition was applied to a paper substrate weighing 45 g/m² in an amount of 5.0 g/m² by dry weight to obtain a color acceptor sheet.

The basic dye sheet and the color acceptor sheet were superposed with their coating surfaces opposed to each other, the assembly was pressed with a pen, then black images were obtained immediately which were high in color density and excellent in resistance to light.

EXAMPLES 2 TO 4

Three kinds of color acceptor sheets were prepared in the same manner as in Example 1 except that the following color acceptor was used in place of 20 parts of zinc salt of 5-[p-(2-phenoxyethoxy)cumyl]salicylic acid in the preparation of the color acceptor sheet in Example 1.

| | | |
|---|---|---|
| Example 2: | zinc salt of 5-(p-n-octadecyloxycumyl)-salicylic acid | 20 parts |
| Example 3: | zinc salt of 5-[p-(2-phenoxyethoxy)-benzyl]salicylic acid | 20 parts |
| Example 4: | zinc salt of 5-[p-(2-phenoxyethoxy)-cumyl]salicylic acid | 10 parts |
| | zinc salt of 3,5-bis(α-methylbenzyl)-salicylic acid | 10 parts |

The color formation was made in the same manner as in Example 1 with use of the above three kinds of color acceptor sheet. In each of Examples 2 to 4, black images were obtained immediately which were high in color density and excellent in resistance to light.

EXAMPLE 5

① Composition A

| | |
|---|---|
| 3-(N-ethyl-N-isoamylamino)-6-methyl-7-phenylaminofluoran | 10 parts |
| 1,2-bis(3-methylphenoxy)ethane | 20 parts |
| 5% aqueous solution of methyl cellulose | 15 parts |
| water | 120 parts |

These components were pulverized by a sand mill to prepare Composition A having an average particle size of 3 μm.

② Composition B

| | |
|---|---|
| Zinc salt of 5-[p-(2-phenoxyethoxy)cumyl]salicylic acid | 30 parts |
| 5% aqueous solution of methyl cellulose | 30 parts |
| water | 70 parts |

These components were pulverized by a sand mill to prepare Composition B having an average particle size of 3 μm.

③ Formation of a Recording Layer

A coating composition for a recording layer was prepared by mixing with stirring 165 parts of Composition A, 130 parts of Composition B, 30 parts of finely divided anhydrous silica (oil absorption 180 ml/100 g), 150 parts of 20% aqueous solution of oxidized starch and 155 parts of water. To a paper substrate weighing 50 g/m² was applied and dried the above coating composition in an amount of 6.0 g/m² by dry weight to obtain a heat sensitive recording paper.

EXAMPLES 6 TO 25

Twenty kinds of heat sensitive recording papers were prepared in the same manner as in Example 5 except that the following compound was used in place of zinc salt of 5-[p-(2-phenoxyethoxy)cumyl]salicylic acid in the preparation of the Composition B in Example 5.

Example 6: zinc salt of 5-[p-(2-p-methoxyphenoxyethoxy)cumyl]salicylic acid

Example 7: zinc salt of 5-[p-(3-p-tolyloxypropoxy)-cumyl]salicylic acid

Example 8: zinc salt of 5-[p-(4-p-chlorophenoxybutoxy)cumyl]salicylic acid

Example 9: zinc salt of 5-[p-(5-phenoxy-3-oxapentyloxy)cumyl]salicylic acid

Example 10: zinc salt of 5-[p-(2-β-naphthyloxyethoxy)-cumyl]salicylic acid

Example 11: zinc salt of 5-(p-n-dodecyloxycumyl)salicylic acid

Example 12: zinc salt of 5-[p-(3-p-tolylsulfonylpropoxy)cumyl]salicylic acid

Example 13: zinc salt of 5-[p-(4-phenylsulfonylbutoxy)-cumyl]salicylic acid

Example 14: zinc salt of 3-(p-n-octadecyloxybenzyl)salicylic acid

Example 15: zinc salt of 4-[p-(2-phenoxyethoxy)cumyl]-salicylic acid

Example 16: zinc salt of 5-[1-p-(2-phenoxyethoxy)-phenylcyclohexyl]salicylic acid Example 17: zinc salt of 5-[α-methyl-α-isopropyl-p-(2-phenoxyethoxy)benzyl]salicylic acid Example 18: zinc salt of 3-methyl-5-[p-(2-phenoxyethoxy)cumyl]salicylic acid Example 19: zinc salt of 5-[m-chloro-p-(2-phenoxyethoxy)cumyl]salicylic acid Example 20: calcium salt of 5-[p-(2-phenoxyethoxy)-cumyl]salicylic acid Example 21: magnesium salt of 5-[p-(2-phenoxyethoxy)-cumyl]salicylic acid Example 22: calcium salt of 5-[p-(2-phenoxyethoxy)-cumyl]salicylic acid Example 23: 5-[p-(2-phenoxyethoxy)cumyl]salicylic acid Example 24: 5-(p-n-octadecyloxycumyl)salicylic acid Example 25: 5-[p-(2-phenoxyethoxy)benzyl]salicylic acid

EXAMPLE 26

A heat sensitive recording paper was prepared in the same manner as in Example 5 except that 30 parts of zinc oxide and 40 parts of water were used in place of 70 parts of water in the preparation of the Composition B in Example 5.

EXAMPLES 27 TO 39

Thirteen kinds of heat sensitive recording papers were prepared in the same manner as in Example 26 except that the following compound was used in place of zinc salt of 5-[p-(2-phenoxyethoxy)cumyl]salicylic acid in the preparation of the Composition B in Example 26.

Example 27: zinc salt of 5-(p-n-octadecyloxycumyl)salicylic acid

Example 28: zinc salt of 5-[p-(5-phenoxy-3-oxapentyloxy)cumyl]salicylic acid

Example 29: 5-[p-(2-phenoxyethoxy)cumyl]salicylic acid

Example 30: 5-[p-(2-p-methoxyphenoxyethoxy)cumyl]-salicylic acid

Example 31: 5-[p-(2-p-isopropoxyphenoxyethoxy)-cumyl]salicylic acid

Example 32: 5-[p-(2-β-naphthyloxyethoxy)cumyl]salicylic acid

Example 33: 5-[p-(3-p-tolylsulfonylpropoxy)cumyl]salicylic acid

Example 34: 5-[p-(3-p-methoxyphenylsulfonylpropoxy)cumyl]salicylic acid

Example 35: 5-[p-(6-p-chlorophenylsulfonylhexyloxy)-cumyl]salicylic acid

Example 36: 3-(p-n-octadecyloxybenzyl)salicylic acid

Example 37: 4-[p-(2-phenoxyethoxy)cumyl]salicylic acid

Example 38: 5-[1-p-(2-phenoxyethoxy)phenylcyclohexyl]salicylic acid

Example 39: 5-[α-methyl-α-isopropyl-p-(2-phenoxyethoxy)benzyl]salicylic acid

EXAMPLES 40 TO 42

Three kinds of heat sensitive recording papers were prepared in the same manner as in Example 29 except that the following compound was used in place of zinc oxide in the preparation of Composition B in Example 29.

Example 40: calcium carbonate

Example 41: magnesium oxide

Example 42: aluminum hydroxide

COMPARISON EXAMPLES 1 TO 6

Six kinds of heat sensitive recording papers were prepared in the same manner as in Example 5 except that the following compound was used in place of zinc salt of 5-[p-(2-phenoxyethoxy)cumyl]salicylic acid in the preparation of Composition B in Example 5.

Comparison Example 1: 4,4'-isopropylidenediphenol

Comparison Example 2: 4,4'-cyclohexylidenebisphenol

Comparison Example 3: dimethyl 4-hydroxy-o-phthalate

Comparison Example 4: zinc salt of 3,5-bis(α-methylbenzyl)salicylic acid

Comparison Example 5: zinc salt of p-chlorobenzoic acid

Comparison Example 6: zinc salt of 5-cumylsalicylic acid

The 44 kinds of heat sensitive recording papers thus prepared were fed to a heat sensitive facsimile system (Model HIFAX-700, product of Hitachi Ltd.) for recording and checked for color density of the recorded images by a Macbeth densitometer (Model RD-914, product of Macbeth Corp.). Table 1 shows the results.

The heat sensitive recording papers used for recording were allowed to stand in a dry atmosphere at a high temperature of 60° C. for 20 hours or under the conditions of 40° C. and 90% RH for 20 hours, and thereafter checked for the color density of each of the recorded images to evaluate the resistance of the images to heat and moisture. Table 1 also shows the results.

Further for the evaluation of chemical resistance, the heat sensitive recording papers used for recording were allowed to stand at room temperature for 20 hours with polyvinyl chloride film superposed on the image bearing surface (plasticizer resistance), or coated with ethanol over the image bearing surface (ethanol resistance), or coated with cotton seed oil over the image bearing surface (oil resistance), and were checked for the fogging of blank areas and the degree of fading of the recorded images. Table 1 shows the results.

The results given in Table 1 reveal that the recording materials of the present invention are high in color density, excellent in the preservability of recorded images and free of fading of color images and blank areas fogging due to chemicals.

TABLE 1

| | color density | color density | | plasticizer resistance | | ethanol resistance | | oil resistance | |
|---|---|---|---|---|---|---|---|---|---|
| | color density | after heat resistance test | after moisture resistance test | fogging | fading | fogging | fading | fogging | fading |
| Ex. 5 | 1.26 | 1.21 | 1.17 | ○ | ○ | ○ | ○ | ○ | ○ |
| Ex. 6 | 1.25 | 1.20 | 1.18 | ◎ | ○ | ○ | ○ | ○ | ○ |
| Ex. 7 | 1.25 | 1.21 | 1.17 | ○ | ○ | ○ | ○ | ○ | ○ |
| Ex. 8 | 1.23 | 1.19 | 1.15 | ○ | ○ | ○ | ○ | ○ | ○ |
| Ex. 9 | 1.23 | 1.18 | 1.15 | ◎ | ○ | ◎ | ○ | ○ | ○ |
| Ex. 10 | 1.24 | 1.21 | 1.18 | ○ | ◎ | ○ | ◎ | ○ | ○ |
| Ex. 11 | 1.23 | 1.17 | 1.14 | ○ | ○ | ○ | ○ | ○ | ○ |
| Ex. 12 | 1.25 | 1.21 | 1.17 | ○ | ◎ | ○ | ◎ | ○ | ○ |
| Ex. 13 | 1.24 | 1.20 | 1.17 | ○ | ◎ | ○ | ◎ | ○ | ○ |
| Ex. 14 | 1.22 | 1.17 | 1.13 | ○ | ○ | ○ | ○ | ○ | ○ |
| Ex. 15 | 1.24 | 1.20 | 1.16 | ○ | ○ | ○ | ○ | ○ | ○ |
| Ex. 16 | 1.25 | 1.21 | 1.18 | ○ | ◎ | ○ | ○ | ○ | ○ |
| Ex. 17 | 1.24 | 1.19 | 1.17 | ○ | ○ | ○ | ○ | ○ | ○ |
| Ex. 18 | 1.25 | 1.19 | 1.18 | ○ | ○ | ○ | ○ | ○ | ○ |
| Ex. 19 | 1.23 | 1.18 | 1.16 | ○ | ○ | ○ | ○ | ○ | ○ |
| Ex. 20 | 1.23 | 1.15 | 1.11 | ○ | Δ | ○ | ○ | ○ | ○ |
| Ex. 21 | 1.24 | 1.16 | 1.13 | ○ | Δ | ○ | ○ | ○ | ○ |
| Ex. 22 | 1.22 | 1.14 | 1.10 | ○ | Δ | ○ | ○ | ○ | ○ |
| Ex. 23 | 1.23 | 1.12 | 1.05 | ○ | Δ | ○ | ○ | ○ | ○ |
| Ex. 24 | 1.22 | 1.10 | 1.04 | ○ | Δ | Δ | ○ | Δ | ○ |
| Ex. 25 | 1.24 | 1.13 | 1.06 | ○ | Δ | ○ | ○ | Δ | ○ |
| Ex. 26 | 1.32 | 1.27 | 1.23 | ○ | ◎ | ○ | ◎ | ○ | ○ |
| Ex. 27 | 1.30 | 1.25 | 1.21 | ○ | ○ | ○ | ○ | ○ | ○ |
| Ex. 28 | 1.31 | 1.24 | 1.20 | ◎ | ○ | ◎ | ◎ | ○ | ○ |
| Ex. 29 | 1.27 | 1.22 | 1.19 | ◎ | ◎ | ◎ | ◎ | ○ | ○ |
| Ex. 30 | 1.25 | 1.21 | 1.18 | ◎ | ◎ | ◎ | ◎ | ○ | ○ |
| Ex. 31 | 1.23 | 1.20 | 1.17 | ◎ | ◎ | ◎ | ◎ | ○ | ○ |
| Ex. 32 | 1.25 | 1.22 | 1.20 | ○ | ◎ | ○ | ◎ | ○ | ○ |

TABLE 1-continued

| | color density | color density after heat resistance test | color density after moisture resistance test | plasticizer resistance fogging | plasticizer resistance fading | ethanol resistance fogging | ethanol resistance fading | oil resistance fogging | oil resistance fading |
|---|---|---|---|---|---|---|---|---|---|
| Ex. 33 | 1.26 | 1.22 | 1.19 | ○ | ◎ | ◎ | ◎ | ○ | ○ |
| Ex. 34 | 1.25 | 1.20 | 1.18 | ◎ | ◎ | ◎ | ◎ | ○ | ○ |
| Ex. 35 | 1.23 | 1.19 | 1.17 | ○ | ◎ | ○ | ◎ | ○ | ○ |
| Ex. 36 | 1.24 | 1.20 | 1.16 | ◎ | ○ | ○ | ○ | ○ | ○ |
| Ex. 37 | 1.25 | 1.20 | 1.17 | ◎ | ◎ | ◎ | ◎ | ○ | ○ |
| Ex. 38 | 1.27 | 1.22 | 1.18 | ○ | ○ | ○ | ◎ | ○ | ○ |
| Ex. 39 | 1.25 | 1.20 | 1.18 | ◎ | ○ | ○ | ◎ | ○ | ○ |
| Ex. 40 | 1.24 | 1.16 | 1.12 | ○ | Δ | ○ | ○ | ○ | ○ |
| Ex. 41 | 1.25 | 1.16 | 1.13 | ○ | Δ | ○ | ○ | ○ | ○ |
| Ex. 42 | 1.24 | 1.15 | 1.11 | ○ | Δ | ○ | ○ | ○ | ○ |
| Com. Ex. 1 | 1.17 | 0.90 | 0.63 | ○ | X | X | ○ | ○ | X |
| Com. Ex. 2 | 1.08 | 1.00 | 0.79 | Δ | X | X | ○ | Δ | X |
| Com. Ex. 3 | 1.20 | 1.03 | 0.84 | ○ | X | X | ○ | ○ | X |
| Com. Ex. 4 | 1.15 | 1.11 | 1.01 | X | ○ | X | ○ | X | ○ |
| Com. Ex. 5 | 1.05 | 0.98 | 0.95 | X | Δ | X | ○ | X | ○ |
| Com. Ex. 6 | 1.13 | 1.08 | 0.98 | X | ○ | X | ○ | X | ○ |

◎: extremely excellent
○: excellent
Δ: practically usable
X: practically unusable

We claim:

1. A recording material utilizing a color forming reaction between a colorless or light-colored basic dye and a color acceptor reactive with the dye to form a color, the recording material being characterized in that the color acceptor includes at least one salicylic acid derivative represented by

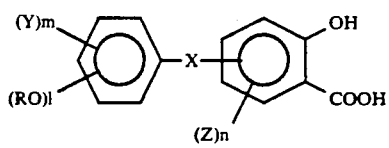

[I]

wherein X is straight-chain or branched-chain $C_{1-12}$ alkylene or $C_{5-12}$ cycloalkylene, R is unsubstituted or substituted $C_{1-20}$ alkyl or unsubstituted or substituted $C_{2-20}$ alkenyl, Y is $C_{1-6}$ alkyl, $C_{2-6}$ alkenyl, $C_{7-10}$ aralkyl or halogen atom, Z is $C_{1-6}$ alkyl, $C_{2-6}$ alkenyl, $C_{7-10}$ aralkyl, $C_{1-6}$ alkoxyl, cyclohexyl, phenyl, phenoxy or halogen atom, l is an integer of 1 to 3, m is zero or an integer of 1 to 4, n is zero or an integer of 1 to 3.

2. A recording material as defined in claim 1 wherein, in the formula [I], R is 8 to 26 in total carbon number.

3. A recording material as defined in claim 2, wherein, in the formula [I], R is alkyl group represented by the formula [II]

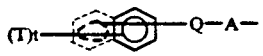

[II]

wherein R is halogen atom, $C_{1-4}$ alkyl or $C_{1-4}$ alkoxyl, Q is —O— bond or —$SO_2$— bond, A is $C_{2-6}$ alkylene or $C_{2-6}$ alkylene having one or two ethers bonds, t is zero or an integer of 1 to 5.

4. A recording material as defined in claim 1 wherein, in the formula [I], X is straight-chain or branched-chain $C_{1\sim6}$ alkylene.

5. A recording material as defined in claim 4 wherein, in the formula [I], X is isopropylidene group.

6. A recording material as defined in claim 1 wherein, in the formula [I], Y is $C_{1\sim4}$ alkyl, chlorine atom or bromine atom.

7. A recording material as defined in claim 1 wherein, in the formula [I], Z is $C_{1\sim4}$ alkyl, $C_{1\sim4}$ alkoxyl, chlorine atom or bromine atom.

8. A recording material as defined in claim 1 wherein, in the formula [I], l is 1.

9. A recording material as defined in claim 1 wherein, in the formula [I], m and n are zero.

10. A recording material as defined in claim 1 wherein, as the color acceptor, at least one of the salicylic acid derivative of the formula [I] or polyvalent metal salt thereof is used conjointly with a metal compound.

11. A recording material as defined in claim 10 wherein the metal compound is used in an amount of 1 to 500 parts by weight per 100 parts by weight of at least one selected from the group consisting of the salicylic acid derivative and polyvalent metal salt thereof.

12. A recording material as defined in claim 1 wherein the recording material is a heat sensitive recording material.

13. A recording material as defined in claim 1 wherein the recording material is a pressure sensitive recording material.

14. A recording material as defined in claim 1 wherein at least one selected from the group consisting of the salicylic acid derivative and polyvalent metal salt thereof is used in an amount of 50 to 500 parts by weight per 100 parts by weight of the basic dye.

* * * * *